US005692749A

United States Patent [19]

Vogeler

[11] Patent Number: 5,692,749

[45] Date of Patent: Dec. 2, 1997

[54] MATCHING PUZZLE WITH MULTIPLE SOLUTIONS

[76] Inventor: Roger Vogeler, 440 E. Pepperidge Dr., Midvale, Utah 84047

[21] Appl. No.: 701,197

[22] Filed: Aug. 21, 1996

[51] Int. Cl.[6] ..... A63F 3/00

[52] U.S. Cl. ..... 273/157 R; 273/275

[58] Field of Search ..... 273/157 R, 153 S, 273/275, 153 R

[56] References Cited

U.S. PATENT DOCUMENTS

| | | | |
|---|---|---|---|
| 2,202,592 | 5/1940 | Maxson | 273/157 R |
| 3,309,092 | 3/1967 | Hardesty et al. | 273/157 R |
| 3,464,145 | 9/1969 | Martin | 273/157 R |
| 3,643,956 | 2/1972 | Bovasso | 273/157 R |
| 4,177,305 | 12/1979 | Feingold et al. | 273/157 R |
| 4,180,271 | 12/1979 | McMurchie | 273/275 |

*Primary Examiner*—Steven B. Wong

[57] ABSTRACT

A tiling, pattern-matching puzzle having a large number of distinct, challenging solutions while maintaining in each solution an overall unity and perceptible wholeness. This is achieved by providing each puzzle piece with a surface design comprising a number of distinct regions separated by contour lines terminating at precisely spaced points along the edges of the piece.

13 Claims, 3 Drawing Sheets

MATCHING PUZZLE WITH MULTIPLE SOLUTIONS

BACKGROUND

1. Field of Invention

This invention relates to puzzles, specifically to puzzles having many pieces, each of which has a surface design or pattern, and which fit together along matching edges to form a unified whole.

2. Discussion of Prior Art

Puzzles of a geometric nature have been enjoyed in endless variety for countless years. One popular class of such puzzles consists of those in which a set of separate pieces, each having a substantially planar face and capable of matching or interfitting edge-to-edge with other pieces, must be arranged into some sort of overall whole. I have enjoyed many of these, and find that they fall into several categories based on certain inherent limitations.

The largest such category consists of puzzles which have precisely one predetermined completed arrangement, or solution. The members of this broad category cover the range from very simple to highly complex, but share a common disadvantage: after solving them a single time the typical player has little interest in trying again, since the outcome has already been discovered. Thus the existence of a unique solution can actually be considered a limitation. The common jigsaw puzzle is the most familiar example from this category; others are shown by Stein et al, U.S. Pat. No. 4,361,328 (1982); and Clark, U.S. Pat. No. 4,410,180 (1983).

A second limitation-based category consists of puzzles which, in their solved state, have no apparent unifying pattern or perceptible overall wholeness, as provided, for example, by the completed picture of a traditional jigsaw puzzle. There may be pattern-matching where pieces come together, but this is discrete and localized rather than continuously extended over the entire assembly. This generally detracts from the aesthetic appeal of the puzzle, and deprives the player of an important motivation: namely, the progressive revelation of a whole greater than the sum of the individual parts. It is true that many of these puzzles are based on interesting combinatorial principles, which may be said to provide the puzzle with an overall unity; but such principles are abstract and invisible, and rather than providing motivation by their gradual emergence, they simply ensure that the ignorant player will find the puzzle rather meaningless and perhaps impossible, while the knowing player finds it merely academic. Clearly, neither player will derive much satisfaction from actually working the puzzle, since the real challenge is not in putting the pieces together, but in deducing the underlying principle. Many other puzzles in this category, in contrast to the combinatorial type, lack even an underlying, abstract unity. Though varying in difficulty, these tend to be uniformly uninteresting. Some good examples from this category are shown by Rankin, U.S. Pat. No. 1,006,878 (1911); Stein et al, mentioned above as a member of the previous category also; Fritzman, U.S. Pat. No. 4,715,605 (1987); and Hillis, U.S. Pat. No. 4,830,376 (1989).

Finally, a third category consists of inventions which are not really puzzles in the purest sense, but simply sets of combinable pieces that can be arranged to depict prescribed or original patterns and pictures. In many cases there is no strict requirement of edge-matching, although matching of patterns along edges may frequently be advantageous in producing certain depictions; in other cases, pattern-matching is automatic and unavoidable by virtue of the design of the pieces. These inventions clearly have their place in education and entertainment, providing creative, open-ended systems for exploring graphic design and for developing spatial thinking skills. Just as clearly, however, they lack the well-defined challenges and precise solutions characteristic of true puzzles. Exemplary members of this category are shown by Graham, U.S. Pat. No. 1,973,564 (1934); Krahn, U.S. Pat. No. 3,755,923 (1973); Estvan, U.S. Pat. No. 3,759,526 (1973); and Hidvegi, U.S. Pat. No. 4,717,342 (1988).

OBJECTS AND ADVANTAGES

Accordingly, several objects and advantages of my invention are:

(a) to provide a puzzle having multiple solutions, so that a player's interest will not diminish after solving it once;

(b) to provide a puzzle in which each solution has a perceptible overall unifying pattern;

(c) to provide a true and challenging puzzle, in the sense that there exists a concise statement specifying the requirements of solution without indicating how such a solution may be achieved.

An additional object of my invention is to provide a puzzle requiring relatively few pieces and a small work space, allowing small, compact, and easily portable embodiments.

Further objects and advantages of my puzzle will become apparent from a consideration of the drawings and descriptions.

BRIEF DESCRIPTION OF THE DRAWINGS

FIG. 1 is a plan view of the whole puzzle in a solution configuration.

FIG. 2 is a perspective view of a typical single piece of the puzzle.

FIG. 3 is a schematic for the design of a typical single piece, indicating the spacing of termination points along one edge.

FIG. 4 is a plan view of a single piece in a first alternate embodiment.

FIG. 5 illustrates a matching arrangement of several pieces in a second alternate embodiment.

FIG. 6 is a schematic for the design of a piece in a third alternate embodiment.

FIG. 7 illustrates a possible tiling arrangement of several pieces in the third alternate embodiment.

DESCRIPTION OF THE PREFERRED EMBODIMENT

Figure 1:
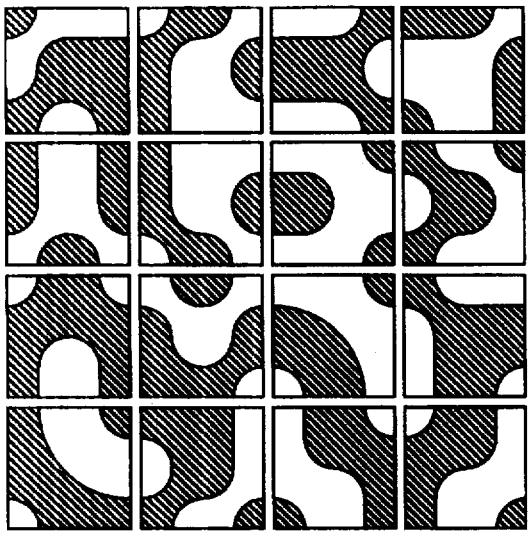
FIGS. 1 to 3 refer to the preferred embodiment of my puzzle.
Figure 2:
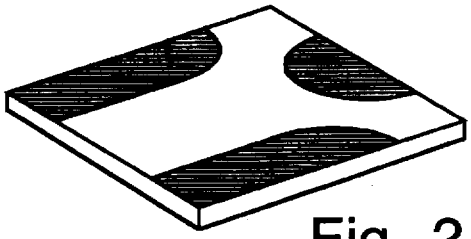
Figure 3:
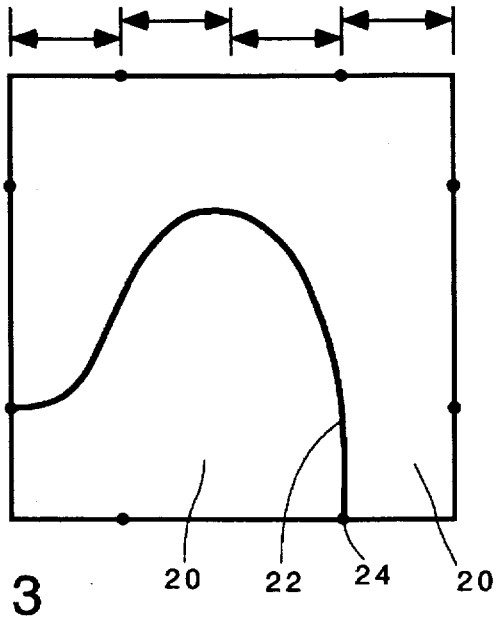

The preferred embodiment of my invention, illustrated in FIGS. 1 to 3, is a puzzle consisting of sixteen congruent square pieces which can be arranged to form a larger 4-by-4 square. Each piece has on its face a unique design, formed by partitioning the square face into a number of regions 20 alternately colored black and white. The common boundaries of the black and white regions 20 are formed by non-intersecting paths or contour lines 22, each of which extends over the square face and connects two precisely spaced termination points 24 on the perimeter. The perimeter is thus partitioned into black and white sub-intervals. The challenge is to assemble the 4-by-4 array in such a way that wherever two pieces meet their black and white regions 20 match along the shared edge. This matching entails the conjunction of termination points 24, thus ensuring that the contour lines 22 of adjacent pieces meet and align to form continuously extended paths over a multiplicity of pieces. The black and white surface regions 20 likewise align to form a pattern of continuously extended black and white regions over the entire face of the large 4-by-4 square. It is by virtue of this extended pattern that the puzzle achieves a perceptible overall wholeness transcending the local matchings along individual edges.

The points on the perimeter of each piece at which the contour lines terminate are selected from a limited set. Specifically, the distance from each termination point to the nearest corner of the square face is equal to one-fourth the length of a side of the square face. This provides two special benefits. Aesthetically, it contributes to a pleasing sense of balance between adjacent black and white regions in the assembled puzzle; more importantly, it allows for only a limited number of distinct possible patterns of black and white sub-intervals along any edge of any square face. The result is that many different combinations of pieces can be matched edge-to-edge in various ways. Accordingly, many different solutions, or complete 4-by-4 matching arrangements, are possible; nevertheless, most partial solutions, or matching arrangements of fewer than all sixteen pieces, cannot be extended to a full 4-by-4 solution. Herein lies the principal challenge of the puzzle.

This preferred embodiment has two other important features. First, all the contour lines are so configured as to meet the perimeter of their respective square faces in a perpendicular fashion. This ensures that aligned contour lines extending across adjacent faces extend not just continuously, but also smoothly, without forming an angle. Second, the pattern on the face of each piece of the puzzle is designed so that every edge of the square face contains at least one termination point of a contour line.

Now, in designing the pieces as just described, care must be taken to ensure that the number of solutions is greater than one, but not so great as to make the puzzle non-challenging. A certain amount of skill and practice are beneficial here; nevertheless, adequate results can be achieved by employing the following two procedures. First, the existence of one solution can be guaranteed by designing the pieces simultaneously, in a complete 4-by-4 arrangement, rather than separately. Further, two pieces can be made interchangeable by designing them with precisely the same selection of termination points, and hence the same pattern of black and white sub-intervals, on their respective perimeters, but with differently arranged contour lines, and thus different black and white regions, on their respective faces. Swapping these two pieces in the first solution produces a second solution different from the first.

This preferred embodiment has been produced with plastic pieces about 1.3" square and about 0.125" thick. Clearly, though, these details are just a matter of convenience; virtually any sizes, materials, and means of display could be employed within the true spirit of the invention.

The particular design shown in FIG. 1 yields an attractive puzzle with a good level of difficulty. Perhaps surprisingly, it has well over a million solutions.

Alternate Embodiments

My invention readily lends itself to many different embodiments. Variations are possible in nearly all the fundamental design features, though a degree of skill may be required to produce a puzzle that is attractive both intellectually and aesthetically. Instead of squares, other shapes can be used such as rectangles, hexagons, or even combinations of different shapes capable of tiling a planar region. The pieces can even be three-dimensional polyhedra, with multiple faces designed for matching. The number and spacing of termination points along edges can be altered. The number, form, and configuration of the contour lines can be changed, as well as the angle at which they meet the edges. The number of colors used for the surface regions can also vary. At one extreme, all regions have the same color and are distinguished merely by the contour line between them. This makes matching easier, since the matching of colors is automatic. Of course there is no upper limit to the number of colors, or other markings such as textures, that may be used.

FIGS. 4 to 7 illustrate a few possibilities for such alternate embodiments.

Figure 4:
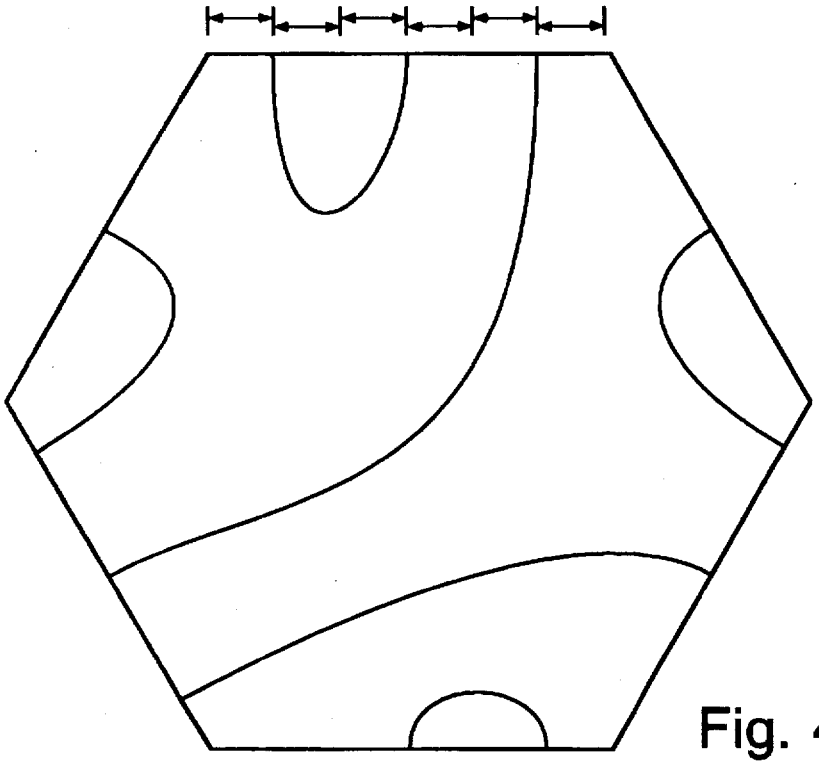
FIGS. 4 to 7 refer to alternate embodiments of my puzzle.

FIG. 4 shows, as a first alternate embodiment, a single piece in the shape of a regular hexagon. Two distances characterize the placement of the termination points, namely, one-sixth and one-half the length of a side of the hexagonal face. Regions are shown all the same color. Spacing of termination points along one edge is indicated.

Figure 5:
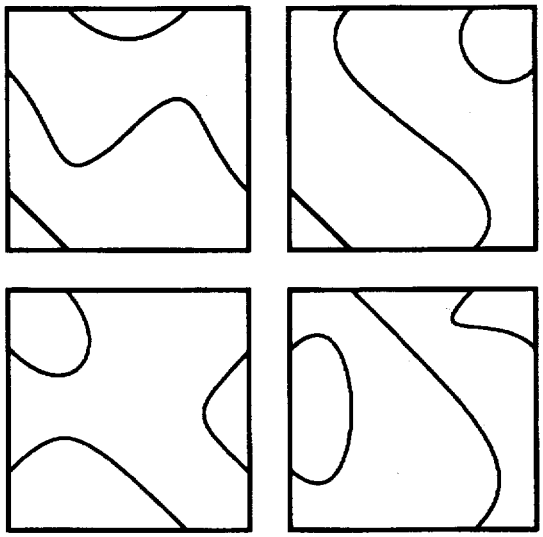

FIG. 5 shows a matching arrangement of four pieces in a second alternate embodiment. Their design is similar to pieces in the preferred embodiment previously described, except that the contour lines meet the perimeter at angles of 45° rather than 90°. At matched edges, contour lines are required to align without forming an angle; the fact that a 45° angle can occur in either of two different orientations thus provides an additional matching requirement.

Figure 6:
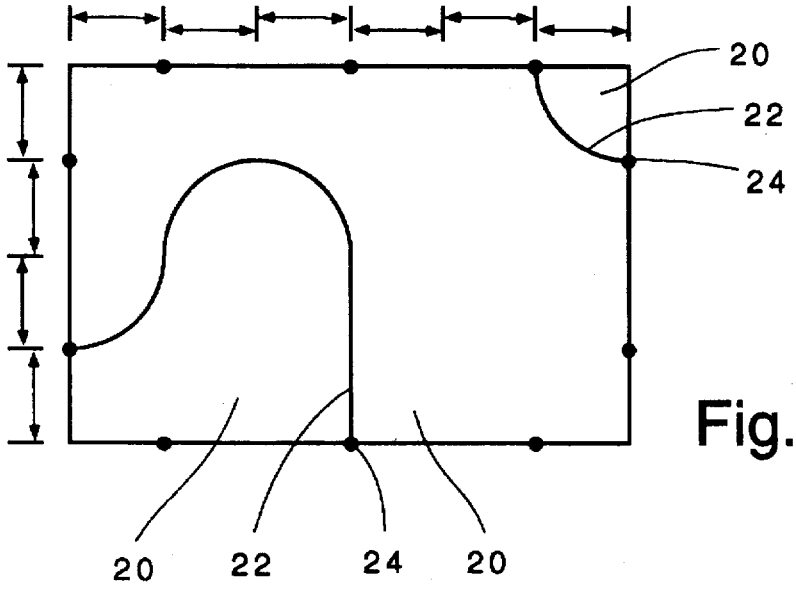
Figure 7:
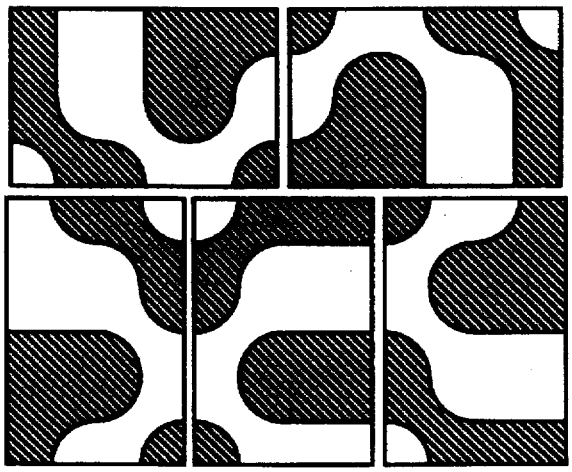

FIG. 6 schematically indicates the design of a single piece in a third alternate embodiment. The shape is a rectangle with an aspect ratio of 4:6. Again, two distances characterize the placement of the termination points 24, namely, one-sixth and one-half the length of the longer side of the rectangular face, as indicated. Two contour lines 22 are shown, splitting the surface into regions 20 of the same color. FIG. 7 shows several such pieces, with the regions of each face colored black and white, in a possible matching arrangement.

Again, many other variations are feasible. The above descriptions should not be construed as limiting the scope of my invention, but rather as simply illustrating a few of its many possible embodiments. The scope of my invention should be determined by the appended claims and their legal equivalents, rather than by the examples given.

I claim:

1. A puzzle comprising a multiplicity of pieces, each of said pieces having a polygonal face, said pieces being jointly assemblable into a tiling configuration, wherein said faces tile a connected polygonal area;

each edge of each polygonal face being partitioned into a pattern of sub-intervals by a non-empty set of termination points, each pattern of sub-intervals being characterized by the associated distances occurring between each of said termination points and the nearest corner of its respective face, each of said distances being selected from a predetermined finite set of distances, and at least two different patterns of sub-intervals occurring within the entire puzzle;

each edge of each face having a matching relationship with at least one edge of one other face wherein, when two such faces are correctly and adjacently positioned with two said edges coinciding, all termination points on one coinciding edge are respectively brought into pair-wise conjunction with all termination points on other coinciding edge;

all termination points belonging to each respective face being connected pair-wise by a set of non-intersecting contour lines upon said face, said contour lines thereby partitioning said face into distinct regions;

whereby said pieces can be assembled into said tiling configuration in which said matching relationship obtains at each coincidence of edges of adjacent faces.

2. The puzzle of claim 1 wherein said faces are mutually congruent.

3. The puzzle of claim 1 wherein said faces are equilateral polygons.

4. The puzzle of claim 1 wherein each of said contour lines meets perpendicularly the perimeter of its respective face at said termination points, two contour lines thereby aligning agonically at each of said pair-wise conjunctions of said termination points.

5. The puzzle of claim 1 wherein each of said contour lines meets the perimeter of its respective face at a predetermined angle, and said matching relationship further includes the agonic alignment of said contour lines at each of said pair-wise conjunctions of said termination points, thereby providing an additional matching requirement.

6. The puzzle of claim 1 wherein said set of distances does not include zero, each member of said set is an odd integral multiple of the least member of said set, and the length of each edge of each of said faces is an even integral multiple of said least member.

7. The puzzle of claim 1 wherein said set of distances includes zero, each member of said set is an integral multiple of the least positive member of said set, and the length of each edge of each of said faces is an integral multiple of said least positive member.

8. The puzzle of claim 1 wherein each of said regions is marked with one of a set of predetermined indices, two regions being marked differently if they are adjacent by virtue of having one of said contour lines as their common boundary, whereby each of said sub-intervals is associated with one of said indices; and said matching relationship further includes matching indices at each coincidence of sub-intervals along coincident edges, thereby providing an additional matching requirement.

9. The puzzle of claim 8 wherein said indices are colors.

10. A puzzle comprising sixteen pieces, each of said pieces having a substantially planar square face, said faces being mutually congruent;

each of said faces being partitioned into distinct regions by two to four non-intersecting contour lines, each of said contour lines having two termination points on the perimeter of its respective face and meeting perpendicularly said perimeter, each of said termination points being located at a specific distance from the nearest corner of said face, said distance being equal to one-fourth the length of an edge of said face, and each edge of each square face containing at least one of said termination points;

each of said regions being marked with one of at least two alternate indices, in every instance two regions being marked differently if they are adjacent by virtue of having one of said contour lines as their common boundary;

each edge of each face having a matching relationship with at least one edge of one other face, and with fewer than all edges of all other faces, wherein, when two such faces are correctly and adjacently positioned with two said edges coinciding, all termination points on one coinciding edge are respectively brought into pair-wise conjunction with all termination points on other coinciding edge, and each pair of said regions brought into adjacency by said coinciding edges are marked with like indices;

whereby said pieces can be assembled into a four-by-four square configuration in which said matching relationship obtains at each coincidence of edges of adjacent faces.

11. A method of designing surface markings for a set of polygons, together capable of covering at least one predetermined polygonal region in at least two different tiling arrangements, comprising the following steps for each of said polygons:

(a) designation of a plurality of points of division along each edge of said polygon, thus dividing said edge into several segments, the two outermost segments of every edge having the same length, and the remaining, interior, segments each having a length twice that of said outermost segments;

(b) selection of an even number 2k of said points of division, at least one of said points being selected from each edge of said polygon;

(c) delineation or representation of a number k of non-intersecting paths or contour lines upon the interior of said polygon, each path having as endpoints, and thereby joining, two of said selected points of division, and no two paths having a common endpoint, said polygon being thereby partitioned into a plurality of regions, each contour line forming the common boundary of two adjacent regions;

each edge of each face having a matching relationship with at least one edge of one other face wherein, when two such faces are correctly and adjacently positioned with two said edges coinciding, all selected points of division on one coinciding edge are respectively brought into pair-wise conjunction with all selected points of division on other coinciding edge; and at least two edges of different faces not having said matching relationship with each other;

whereby said pieces can be assembled into at least one of said tiling arrangements in which said matching relationship obtains at each coincidence of edges of adjacent faces.

12. A method, as defined in claim 11, further including the following step:

placement of one of a set of at least two contrasting indices on each of said regions, different indices being placed upon adjacent regions in every instance.

13. A method, as defined in claim 12, in which said indices are colors.

* * * * *